US006595292B2

(12) United States Patent
Purkis et al.

(10) Patent No.: US 6,595,292 B2
(45) Date of Patent: Jul. 22, 2003

(54) METHOD AND APPARATUS FOR USE WITH TWO OR MORE HYDRAULIC CONDUITS DEPLOYED DOWNHOLE

(75) Inventors: Daniel G. Purkis, Aberdeen (GB); Michael A. Reid, Aberdeen (GB); Stephen Reid, Aberdeen (GB)

(73) Assignee: Halliburton Energy Services, Inc., Dallas, TX (US)

( * ) Notice: Subject to any disclaimer, the term of this patent is extended or adjusted under 35 U.S.C. 154(b) by 98 days.

(21) Appl. No.: 09/976,969

(22) Filed: Oct. 12, 2001

(65) Prior Publication Data

US 2002/0060075 A1 May 23, 2002

(51) Int. Cl.[7] ..... E21B 23/08
(52) U.S. Cl. ..... 166/313; 166/375; 166/133
(58) Field of Search ..... 166/313, 373, 166/374, 375, 129, 131, 133

(56) References Cited

U.S. PATENT DOCUMENTS

| | | | | |
|---|---|---|---|---|
| RE28,588 E | * | 10/1975 | Sizer et al. | 166/313 X |
| 4,077,472 A | | 3/1978 | Gano | |
| 4,143,712 A | * | 3/1979 | James et al. | 166/72 |
| 4,804,045 A | | 2/1989 | Reed | |
| 4,832,381 A | | 5/1989 | Boulton | |
| 4,917,187 A | * | 4/1990 | Burns et al. | 166/279 |
| 5,810,083 A | * | 9/1998 | Kilgore | 166/120 |
| 6,321,842 B1 | * | 11/2001 | Pringle et al. | 166/313 |
| 6,325,144 B1 | * | 12/2001 | Turley et al. | 166/120 |

FOREIGN PATENT DOCUMENTS

| | | |
|---|---|---|
| GB | 1419849 | 12/1975 |
| GB | 2240834 | 8/1991 |

OTHER PUBLICATIONS

International Search Report for PCT Application No.: PCT/US00/32128.

* cited by examiner

*Primary Examiner*—Frank Tsay
(74) *Attorney, Agent, or Firm*—Marlin R. Smith

(57) ABSTRACT

A method and apparatus for use with two or more hydraulic conduits deployed downhole reduces a number of penetrations required through a well bulkhead for a given number of fluid paths extending therethrough. In a described embodiment, a fluid conductor includes multiple fluid paths extending therein. The fluid conductor is installed in an aperture formed through a bulkhead. Couplings are connected on opposite sides of the bulkhead to opposite ends of the fluid conductor. Multiple hydraulic lines are connected to each of the couplings.

39 Claims, 6 Drawing Sheets

METHOD AND APPARATUS FOR USE WITH TWO OR MORE HYDRAULIC CONDUITS DEPLOYED DOWNHOLE

CROSS-REFERENCE TO RELATED APPLICATION

The present application claims the benefit under 35 USC §119 of the filing date of PCT Application No. PCT/US00/32128, filed Nov. 21, 2000, the disclosure of which is incorporated herein by this reference.

BACKGROUND

The present invention relates generally to equipment utilized, and operations performed, in conjunction with a subterranean well and, in an embodiment described herein, more particularly provides a method and apparatus for use with two or more hydraulic fluid conduits deployed downhole.

The use of two or more hydraulic fluid conduits or lines downhole in production wells is becoming more widespread. Typically, a plurality of hydraulic lines are run from surface equipment such as a hydraulic fluid pump and associated control equipment therefor, through a wellhead and to downhole tools in a well. For example, sliding sleeves, interval control valves (ICV's), chokes and other downhole tools may be actuated using hydraulic lines in a well.

The downhole tools may be placed in different, and potentially isolated, sections of a production tubing string. When actuated by the presence of pressurized hydraulic fluid within an associated hydraulic line, a choke or valve can be operated to control a production fluid flow rate within its associated production tubing section. This is but one example of the many ways hydraulic lines are used to actuate downhole tools and control different aspects of wells. A further example of the use of multiple hydraulic lines to control actuation of multiple downhole tools is described in PCT Application No. GB 99/02694.

Generally, when multiple hydraulic lines are used in a well, each hydraulic line must penetrate the wellhead located at the mouth of the wellbore, and must also penetrate other pressure bulkheads, such as packers and other downhole equipment, in order to reach the hydraulically actuated downhole tools. Penetrations through the wellhead and other pressure bulkheads are preferably kept to a minimum, since each penetration represents a possible leak path through a bulkhead.

Unfortunately, in the past, it has been necessary to use a penetration through a bulkhead for each hydraulic line passing through the bulkhead. This situation either requires that the number of penetrations (and thus, the number of possible leakpaths) be increased when additional hydraulic lines pass through the bulkhead, or prevents the use of such additional hydraulic lines when the number of penetrations cannot be increased.

Form the foregoing, it may be clearly seen that it would be highly advantageous to provide a method and apparatus whereby multiple hydraulic lines may be used with a single penetration through a bulkhead. Such a method and apparatus would permit an increased number of hydraulic lines to be used with a given number of penetrations. It is accordingly an object of the present invention to provide such a method and apparatus.

SUMMARY

In carrying out the principles of the present invention, in accordance with an embodiment thereof, a method and apparatus which permits two or more hydraulic fluid paths to extend through a single penetration of a wellhead or other structure is provided which solves the above problem in the art.

According to a first aspect of the present invention, there is provided an apparatus for use with two or more hydraulic fluid conduits deployed downhole. The apparatus includes a fluid conductor which provides a respective and separate fluid path for the fluid contained within each of multiple hydraulic fluid conduits. The fluid conductor is adapted to be at least partially located within an aperture formed through a well bulkhead.

According to another aspect of the present invention, there is provided a method of passing two or more hydraulic fluid paths through an aperture formed through a well bulkhead, the method comprising locating a fluid conductor at least partially within the aperture, the fluid conductor providing a respective and separate fluid path for the fluid contained within each of multiple hydraulic fluid conduits.

The well bulkhead may be a downhole tool such as a packer, electric submersible pump or any other tool located downhole within an open or cased wellbore, or located within production tubing. Alternatively, the bulkhead may be a tubing hanger, wellhead or Christmas tree which is located at least partially outside the wellbore itself, such as at the mouth of the wellbore.

Preferably, the apparatus includes two couplings. The couplings are connected to the fluid conductor on opposite sides of the bulkhead. Each coupling provides a mechanical connection between the multiple hydraulic conduits and the fluid conductor, and further provides fluid communication between each of the hydraulic conduits and a respective one of the fluid paths in the fluid conductor.

In one embodiment, the fluid conductor has multiple bores formed therethrough. Each of the bores corresponds to one of the fluid paths through the fluid conductor. In another embodiment, the fluid conductor includes multiple tubular members. One fluid path is formed within an inner one of the tubes, and another fluid path is formed between two of the tubular members.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
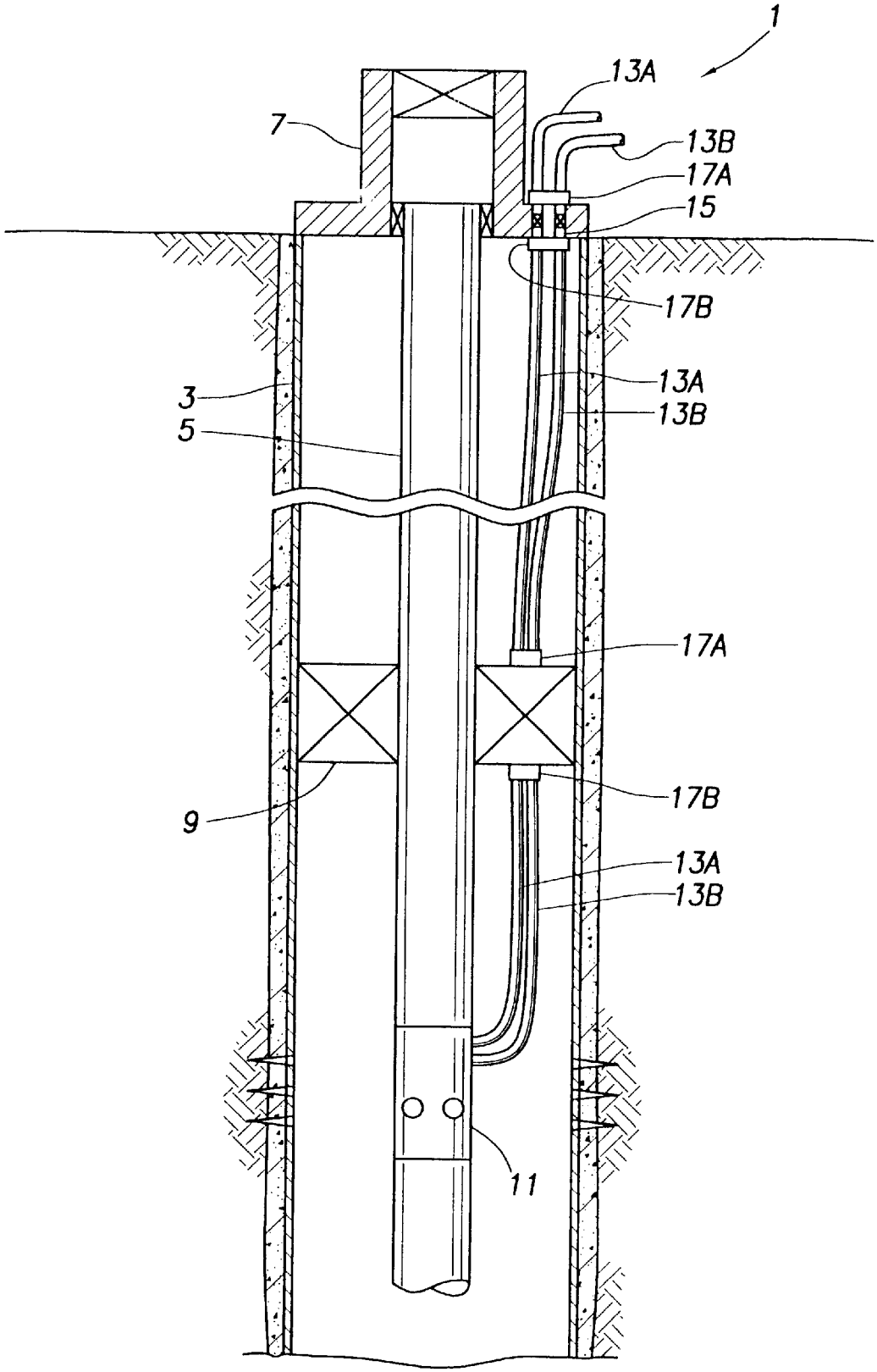
FIG. 1 is a schematic view of a portion of a well incorporating an apparatus and utilizing a method, the apparatus and method embodying principles of the present invention.

Representatively illustrated in FIG. 1 is a method 1 which embodies principles of the present invention. In the following description of the method 1 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

FIG. 1 depicts a well which has been completed in a conventional manner, in that a casing string 3 has been lowered into a drilled wellbore and cemented into place in order to protect the integrity of the wellbore. Thereafter, a production tubing string 5 has been inserted into the inner bore of the casing string 3 and hung from a tubing hanger in a wellhead 7 which is located at or close to the surface of the wellbore. The wellhead 7 provides a pressure bulkhead at the top of the wellbore.

A packer 9 is provided in the tubing string 5. The packer 9 provides a seal between the tubing string 5 and the casing string 3. Thus, the packer 9 also provides a pressure bulkhead in the wellbore.

A hydraulically actuated downhole tool, such as a sliding sleeve valve 11, is also made up into the production tubing string 5. The sliding sleeve valve 11 can be actuated by application of pressurized hydraulic fluid to open or close the valve, such that fluids being produced from a production zone of the well into the casing string 3 can either flow into the production tubing string 5 or be prevented from flowing into the production tubing string. In this manner, if multiple sliding sleeve valves 11 are included in the production tubing string 5 at spaced apart locations, they can be operated to control the production of fluids from different production zones of the well.

A pair of hydraulic fluid conduits or control lines 13A, 13B are run from the surface, or another remote location, to the valve 11 for actuation thereof. A suitable hydraulic fluid pump (not shown) is attached to at least one of the hydraulic lines 13A, 13B, and is actuated to pump pressurized hydraulic fluid down at least one of the hydraulic lines to operate the valve 11 or other hydraulically actuated downhole tool.

It should be noted that one of the hydraulic lines 13A, 13B may serve to supply hydraulic fluid from the pump to the sliding sleeve valve 11, and the other hydraulic line may serve to return the hydraulic fluid from the valve to the pump and/or an associated hydraulic fluid reservoir. Alternatively, both hydraulic lines 13A, 13B may serve to supply hydraulic fluid to the valve 11 and/or other downhole tools, with the hydraulic fluid thereafter being exhausted to the annulus, to the interior of the production tubing string 5 and/or to a downhole formation if its return to surface is not required and/or desired.

Of course, many variations may be made to the well described above, without departing from the principles of the present invention. For example, multiple packers, multiple downhole tools, different downhole tools, more hydraulic lines, etc., may be used. The wellbore may be uncased. The hydraulic lines 13A, 13B may pass through a pressure bulkhead other than, or in addition to, the wellhead 7 at the surface. The hydraulic lines 13A, 13B may pass through additional bulkheads, etc.

As described above, the wellhead 7 and packer 9 are examples of pressure retaining bulkheads used in conjunction with a well. As used herein, the term "bulkhead" means any structure, tool or object which separates differently pressurized regions and presents an obstacle to passage of hydraulic lines therethrough. Due to the function of a bulkhead in separating differently pressurized regions, an aperture formed through a bulkhead for passage of a hydraulic line therethrough typically must not permit any leakage of fluid from one side of the bulkhead to the other. The possibility of such leakage due to the presence of each aperture makes it desirable to reduce the number of apertures which are required through well bulkheads to allow hydraulic lines to pass therethrough.

An aperture 15 is formed through the wellhead 7 shown in FIG. 1. A similar aperture 15 is formed through the packer 9, although the aperture is not visible in FIG. 1. Conventionally, such apertures have an inner diameter somewhat greater than 0.25 in., so that a single 0.25 in. hydraulic line may pass therethrough. Heretofore, it has not been possible to pass more than one fluid conduit through the aperture 15 while maintaining the pressure bearing integrity of the wellhead 7. Thus, only one fluid path could extend through a single aperture.

Figure 2A:
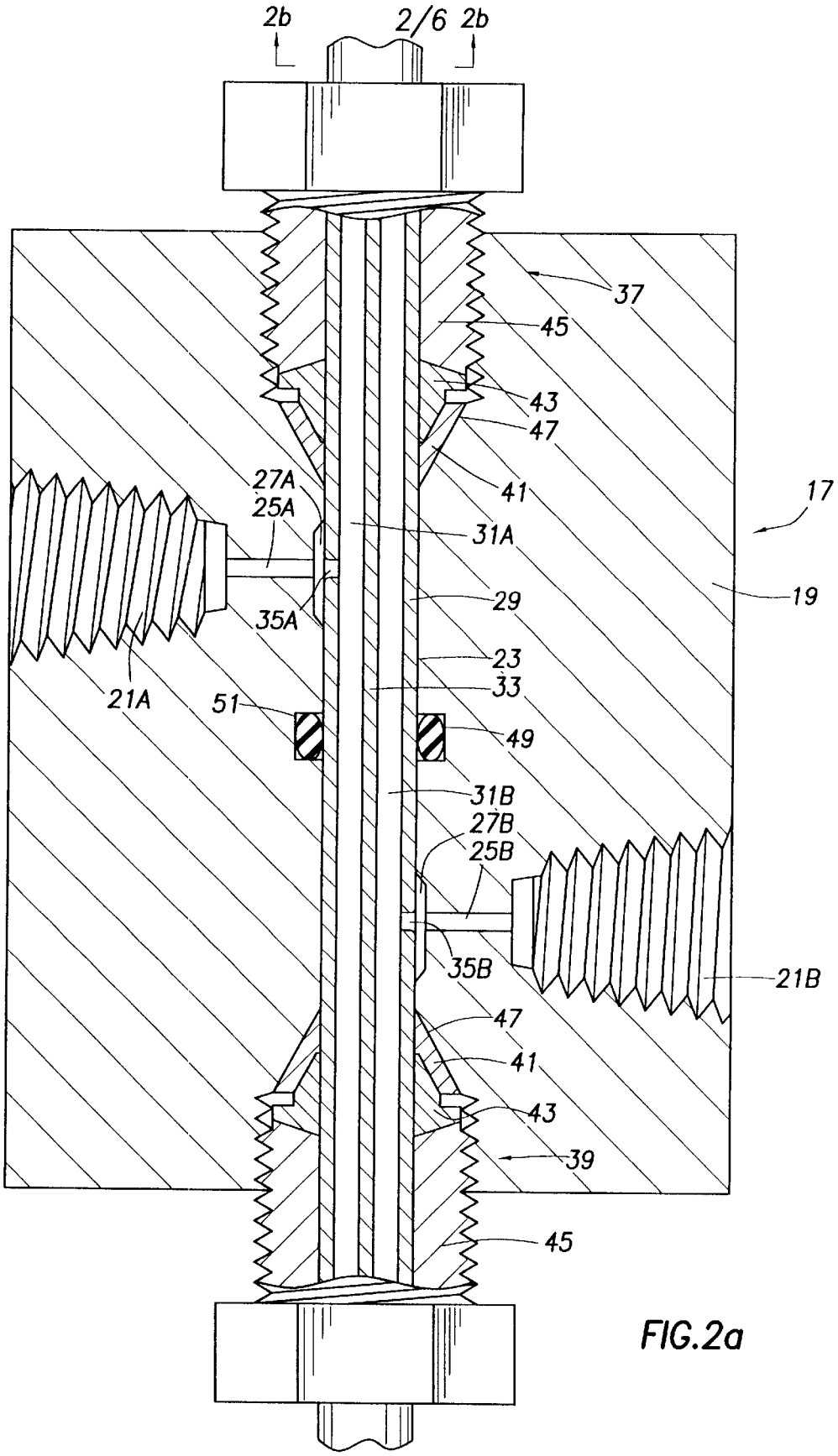
FIG. 2A is a cross-sectional view of a first embodiment of the apparatus shown in FIG. 1.
Figure 2B:
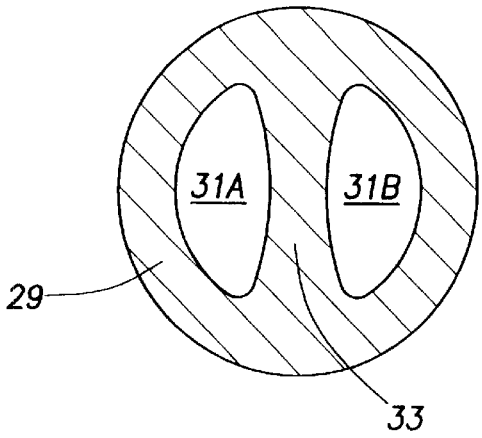
FIG. 2B is a cross-sectional view of a first fluid conductor of the first apparatus, taken along line 2B—2B of FIG. 2A.

Referring additionally now to FIGS. 2A & B, a coupling 17 embodying principles of the present invention is representatively illustrated. The coupling 17 permits two fluid paths to extend through the aperture 15, and permits two hydraulic lines to be interconnected to the fluid paths.

In this manner, the multiple fluid paths associated with the multiple hydraulic lines may extend through a single aperture, without the need for the multiple hydraulic lines themselves to extend through the aperture. The hydraulic lines are connected to a first coupling 17 on one side of a bulkhead, a fluid conductor 29 extends between the first coupling and a second coupling on the other side of the bulkhead, and the hydraulic lines are connected to the second coupling.

In the method 1 depicted in FIG. 1, a first coupling 17A is used above each of the wellhead 7 and the packer 9, and a second coupling 17B is used below each of the wellhead and packer. Thus, a section of the hydraulic lines 13A, 13B connects to the coupling 17A above the wellhead 7, a section of the hydraulic lines connects between the coupling 17B below the wellhead and the coupling 17A above the packer 9, and another section of the hydraulic lines connects between the coupling 17B below the packer and the valve 11.

The coupling 17 includes a housing 19. Two hydraulic connection ports 21A, 21B are respectively formed in the left and right hand sides of the housing 19. The ends of each section of the hydraulic control lines 13A, 13B are provided with suitable conventional connectors such that an end of one of the sections of control line 13A is fitted into side port 21A and an end of one of the sections of control line 13B is fitted into side port 21B. Side ports 21A, 21B are provided with a suitable connection, such as a National Pipe Thread (NPT) connection, which is a standard tapered thread connection.

The housing 19 is provided with a vertical bore 23 therethrough. The side port 21A is arranged to be in fluid communication with the vertical bore 23 via a fluid passage 25*a* and a bore recess 27A. The other side port 21B is also in fluid communication with the vertical bore 23 via a similar fluid passage 25B and bore recess 27B.

A fluid conductor 29 having multiple bores 31A, 31B therein is located longitudinally within the vertical bore 23. The two bores 31A, 31B are separated by a barrier 33. The barrier 33 prevents commingling of hydraulic fluid between the bores 31A, 31B.

An opening 35A is provided in the sidewall of the left hand side of the conductor 29 and a similar sidewall opening 35B is located in the right hand sidewall of the conductor. The conductor 29 and sidewall openings 35A, 35B are arranged within the vertical bore 23 such that the left hand sidewall opening 35A is vertically aligned with the bore recess 27A, and similarly, the right hand sidewall opening 35B is vertically aligned with the bore recess 27B.

When the conductor 29 is located within the housing 19 as previously described, a suitable upper anchoring and sealing device 37 is operated to lock the upper end of the conductor 29 in place. An example of such a suitable device 37 is also shown in FIG. 2A as comprising a tapered ferrule 41, ferrule backup 43 and jam nut 45, and is arranged so that when the jam nut 45 is torqued up, screw threads provided on the outer surface of the jam nut engage screw threads provided on the upper end of the vertical bore 23, such that the jam nut compresses the ferrule backup, which further compresses the tapered ferrule against a tapered surface 47 of the vertical bore 23. This vertical compression also compresses the ferrule 41 radially inwardly to compress against the outer surface of the conductor 29 to lock it in place.

A similar ferrule 41, ferrule backup 43 and jam nut 45 are also shown in FIG. 2A as being a suitable example of a lower anchoring and sealing device 39 and which is also actuated to lock the lower end of the conductor 29 in place. It will be readily appreciated by one skilled in the art that the devices 37, 39 are conventional compression tubing fittings, and that these devices may be replaced by any of a variety of separate or combined anchoring devices and sealing devices.

An o-ring seal 49 is provided within a recess 51 located at approximately the mid-point of the vertical bore 23. The seal 49 operates to seal between the fluid conductor 29 and the bore 23, thereby isolating the upper bore recess 27A with respect to the lower bore recess 27B.

As described above for the method 1, the fluid conductor 29 extends between one coupling 17A positioned on one side of a bulkhead, and another coupling 17B positioned on the other side of the bulkhead. Thus, a fluid conductor 29 extends through the aperture 15 formed through the wellhead 7, and another fluid conductor extends through the aperture formed through the packer 9 shown in FIG. 1. A seal is provided between the outer surface of each of the conductors 29 and the inner surface of each of the apertures 15. Of course, other means of sealing the apertures 15, such as a seal between one or both of the couplings 17A, 17B and the respective bulkhead, etc., may be provided in keeping with the principles of the present invention.

In addition, opposite ends of the fluid conductor 29 are preferably blanked off, so that the bores 31A, 31B do not permit fluid communication completely through the fluid conductor. This may be accomplished by welding the ends of the fluid conductor 29, by the use of plugs in each end of the bores 31A, 31B, or by any other suitable method. Thus, the fluid conductor 29 extends into two of the couplings 17 at either end of the conductor and on opposite sides of a bulkhead, and the bores 31A, 31B provide respective isolated fluid paths between the ports 21A, 21B in the couplings.

Figure 3:
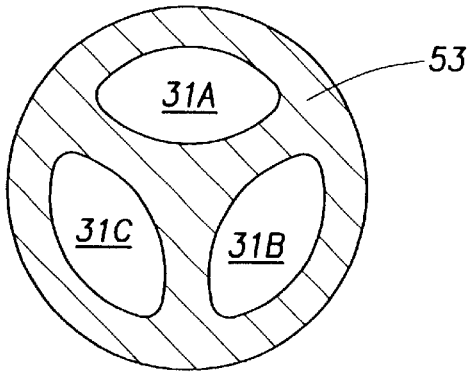
FIGS. 3–6 are cross-sectional views of alternate constructions of the first fluid conductor.
Figure 4:
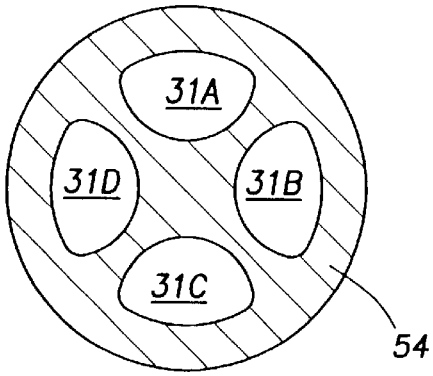
Figure 5:
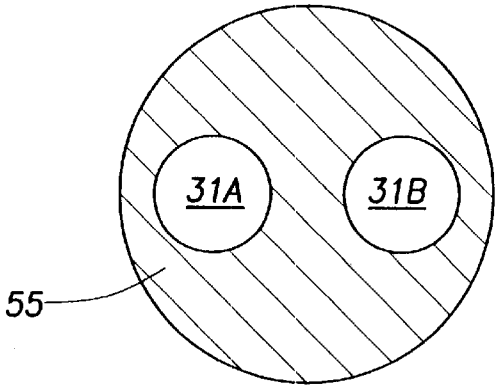
Figure 6:
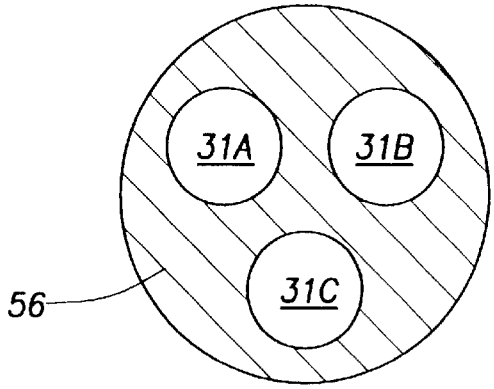

Further embodiments of multiple bore fluid conductors 53, 54, 55 and 56 are shown in FIGS. 3, 4, 5 and 6. FIG. 3 shows a three bore fluid conductor 53, FIG. 4 shows a four bore fluid conductor 54, FIG. 5 shows a two bore fluid conductor 55 and FIG. 6 shows a three bore fluid conductor 56. The fluid conductors 53, 54 may be formed by an extrusion method, and fluid conductors 55, 56 may be formed from a solid bar with the bores 31A, 31B, 31C being drilled by any suitable means.

The fluid conductor 55 can be utilized with the coupling 17 of FIG. 2A, with suitable sidewall openings 35A, 35B being formed therein. The fluid conductors 53, 56 can be used with the coupling 17 of FIG. 2A if an additional hydraulic connection 21, fluid passage 25, bore recess 27 and seal 51 are provided in the coupling at suitable locations, and three suitably located sidewall openings 35 are also provided in the three bore fluid conductors 53, 56.

The fluid conductor 54 can be used with the coupling 17 of FIG. 2A if a further two hydraulic connections 21, fluid passages 25, bore recesses 27 and seals 51 are provided in the coupling 17 at suitable locations, and four suitably located sidewall openings 35 are also provided in the four bore hydraulic fluid conductor 54.

Figure 7:
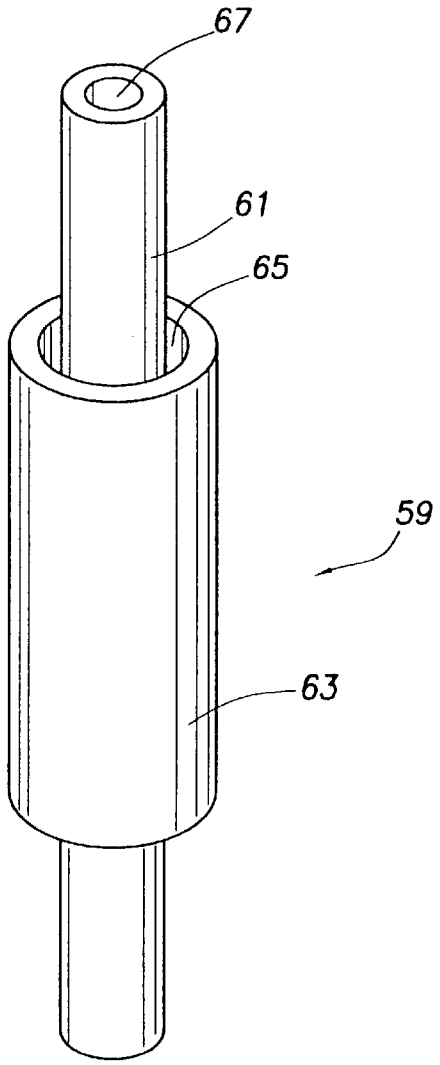
FIG. 7 is a side elevational view of an axial portion of a second fluid conductor.

FIG. 7 shows an alternative multiple fluid path conductor 59. The fluid conductor 59 includes an inner tubular member 61 and an outer tubular member 63. The tubular members 61, 63 are coaxial with respect to one another. Between the inner and outer tubular members 61, 63 is an annulus 65.

An internal bore 67 of the tubular member 61 provides one fluid path through the fluid conductor 59, and the annulus 65 provides another fluid path through the fluid conductor. It will be readily appreciated that a fluid path may still be provided between the tubular members 61, 63, even if the tubular members are not coaxial. In use, the fluid conductor 59 is arranged to extend within an aperture formed through a well bulkhead, with suitable coupling and sealing mechanisms being provided on opposite sides of the bulkhead.

Figure 8:
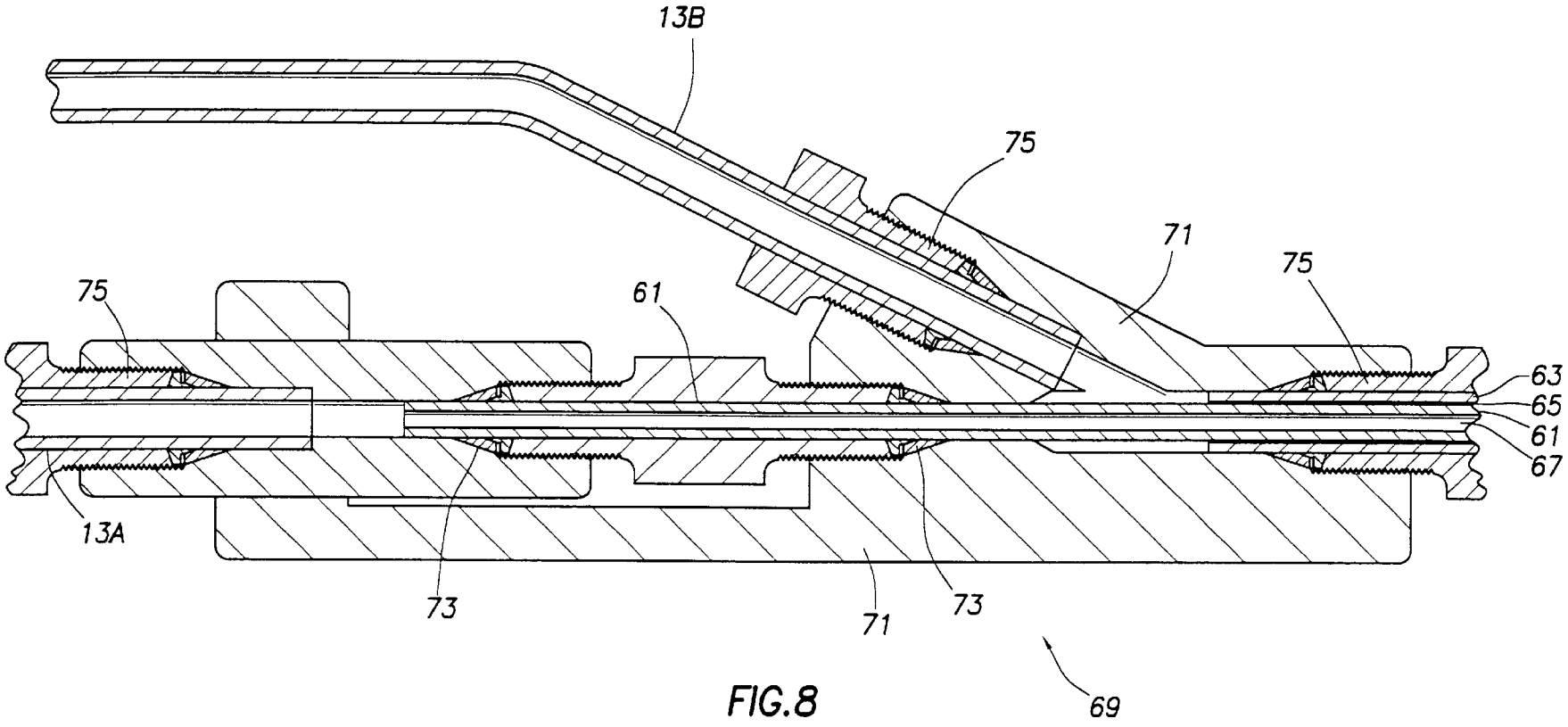
FIG. 8 is a cross-sectional view of a second embodiment of the apparatus shown in FIG. 1, the second apparatus utilizing the second fluid conductor of FIG. 7.

A first example of a coupling 69 for use with the fluid conductor 59 is shown in FIG. 8. The coupling 69 includes a housing 71. The inner member 61 is anchored within the housing 71 by a pair of suitable anchoring and sealing devices 73. The outer member 63 is also anchored and sealed to the housing 71 by a suitable device 75, such that the outer member is coaxial with and located around the inner member 61. However, as mentioned above, it is not necessary for the members 61, 63 to be coaxial.

The control line 13A is also anchored and sealed to the housing 71 by a device 75. The control line 13A, the inner member 61 and the housing 71 are configured such that the control line 13A and the internal bore 67 of the inner member 61 are in fluid communication. The other control line 13B is also secured and sealed to the housing 71 by a device 75 such that the longitudinal axis of the control line 13B is offset by an angle of approximately 30 degrees to the longitudinal axis of the coaxial inner 61 and outer 63 members. The control line 13B, housing 71 and annulus 65 are configured such that the annulus and control line are in fluid communication with one another.

In use of this embodiment, a pair of couplings 69 are provided for use with each bulkhead, such as the wellhead 7 or packer 9. One of the couplings 69 is provided on one side of the bulkhead and another coupling is provided on the other side of the bulkhead, with the fluid conductor 59 extending through the aperture 15 between the couplings. Thus, the coupling 69 may be substituted for the coupling 17, and the fluid conductor 59 may be substituted for the fluid conductor 29, in the method 1 depicted in FIG. 1.

Figure 9:
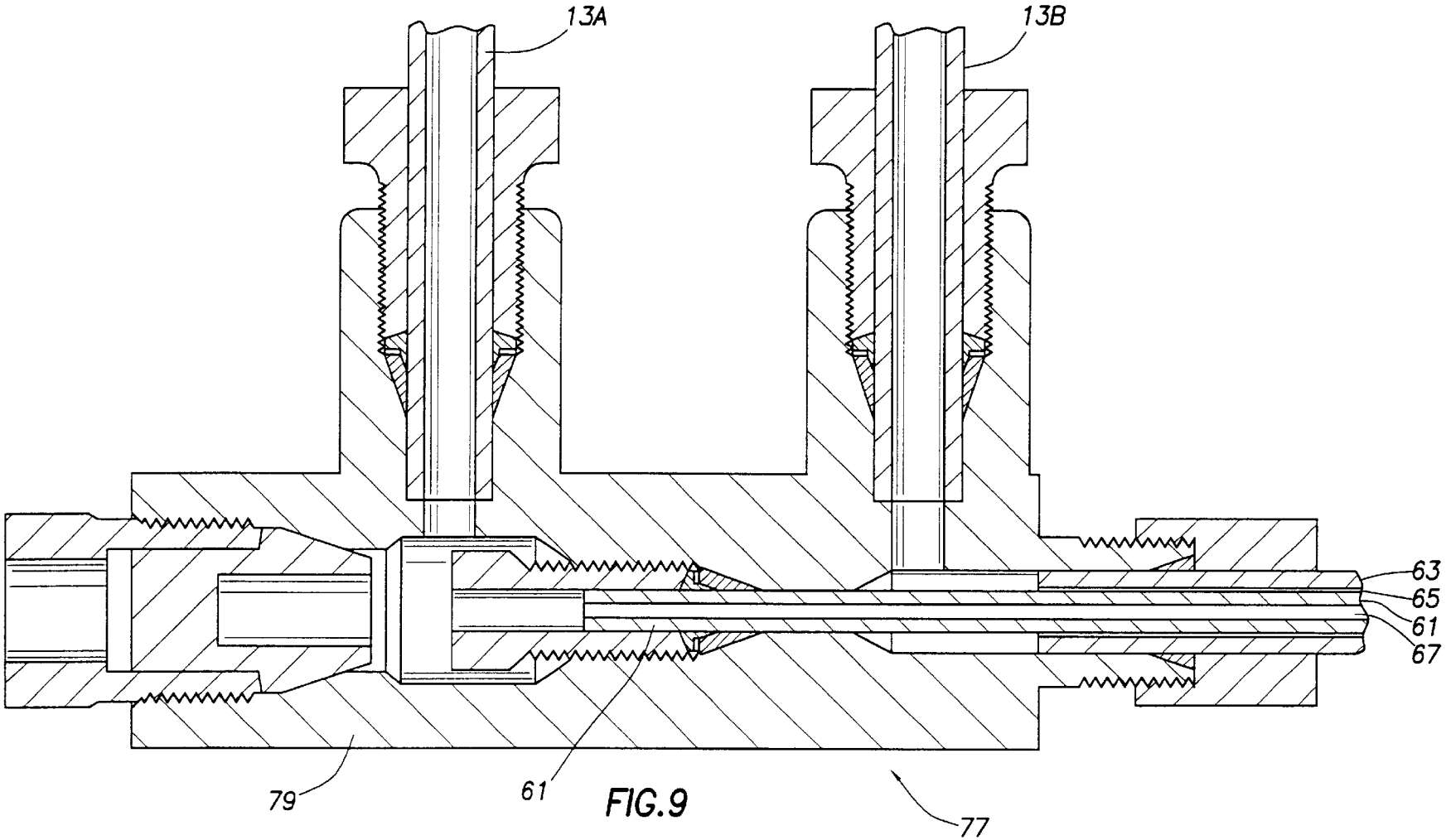
FIG. 9 is a cross-sectional view of a third embodiment of the apparatus shown in FIG. 1, the third apparatus utilizing the second fluid conductor of FIG. 7.

Another alternative embodiment of a coupling 77 for use with the fluid conductor 59 is shown in FIG. 9. The coupling 77 is similar in some respects to the coupling 69. However, a housing 79 of the coupling 77 is configured such that the longitudinal axis of the control line 13A is perpendicular to the longitudinal axis of the inner member 61, and the longitudinal axis of the control line 13B is also perpendicular to the longitudinal axis of the annulus 65. This results in a more vertically compact coupling 77 when compared to the coupling 69. However, the coupling 69 has an advantage in that it is more compact in width than the coupling 77.

The reader will understand that the fluid conductor 59 of FIG. 7 may be combined with any of the multiple bore fluid conductors 29, 53, 54, 55, 56 of FIGS. 2 to 6 as desired, with appropriate combinations of couplings 17, 69, 77 being utilized. Furthermore, any number of the fluid conductors 29, 53, 54, 55, 56, 59 may be utilized.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of providing fluid communication for multiple fluid paths through an aperture formed through a well bulkhead, the well bulkhead having a central flow passage formed axially therethrough, and the aperture being positioned in a pressure-bearing portion of the well bulkhead outside of the central flow passage, the method comprising the step of:

positioning a fluid conductor at least partially within the aperture, the fluid paths extending within the fluid conductor.

2. The method according to claim 1, further comprising the step of forming the fluid paths as bores extending at least partially through the fluid conductor.

3. The method according to claim 1, further comprising the step of forming at least one of the fluid paths as an annular space disposed between multiple tubular members of the fluid conductor.

4. The method according to claim 1, further comprising the step of providing the fluid conductor including a first tubular member disposed within a second tubular member, a first one of the fluid paths being formed within the first tubular member, and a second one of the fluid paths being formed between the first and second tubular members.

5. The method according to claim 1, further comprising the steps of:

interconnecting a first coupling to the fluid conductor; and connecting a plurality of first fluid lines to the first coupling on a first side of the well bulkhead, the first coupling providing fluid communication between each of the first fluid lines and a respective one of the fluid paths in the fluid conductor.

6. The method according to claim 5, wherein in the connecting step, the first coupling secures the first fluid lines relative to the fluid conductor.

7. The method according to claim 5, further comprising the steps of:

interconnecting a second coupling to the fluid conductor; and connecting a plurality of second fluid lines to the second coupling on a second side of the well bulkhead, the second coupling providing fluid communication between each of the second fluid lines and a respective one of the fluid paths in the fluid conductor.

8. The method according to claim 1, further comprising the step of interconnecting the fluid conductor to two couplings, the couplings being positioned on respective opposite sides of the well bulkhead.

9. The method according to claim 8, further comprising the step of connecting the couplings to two sections of fluid lines, each section of the fluid lines being connected to a respective one of the couplings.

10. The method according to claim 9, where in the connecting step further comprises providing fluid communication between corresponding ones of the fluid lines in each section via the fluid paths in the fluid conductor.

11. The method according to claim 1, further comprising the step of sealing between the fluid conductor and the aperture.

12. The method according to claim 11, wherein the sealing step further comprises preventing fluid flow through the aperture other than through the fluid paths.

13. An apparatus for use in providing multiple fluid paths through an aperture formed through a well bulkhead, the apparatus comprising:

a fluid conductor having the fluid paths extending at least partially therein, the fluid conductor being inserted at least partially within an aperture formed through a pressure-bearing portion of the well bulkhead outside of a central flow passage formed axially through the well bulkhead; and first and second couplings interconnected at respective first and second opposite ends of the fluid conductor.

14. The apparatus according to claim 13, further comprising a first section of fluid lines connected to the first coupling, such that the first coupling provides fluid communication between each of the fluid lines of the first section and a respective one of the fluid paths.

15. The apparatus according to claim 14, wherein the first coupling secures the first section of fluid lines relative to the fluid conductor.

16. The apparatus according to claim 14, further comprising a second section of fluid lines connected to the second coupling, such that the second coupling provides fluid communication between each of the fluid lines of the second section and a respective one of the fluid paths.

17. The apparatus according to claim 16, wherein the fluid conductor and first and second couplings provide fluid communication between each of the fluid lines of the first section and a respective one of the fluid lines of the second section.

18. The apparatus according to claim 16, wherein the second coupling secures the second section of fluid lines relative to the fluid conductor.

19. The apparatus according to claim 16, wherein the first and second sections of fluid lines are positioned on respective opposite sides of the well bulkhead.

20. The apparatus according to claim 13, wherein the first and second couplings are positioned on respective opposite sides of the well bulkhead.

21. The apparatus according to claim 13, further comprising a seal configured for preventing fluid flow between the fluid conductor and the aperture.

22. The apparatus according to claim 13, wherein the fluid conductor includes an elongated member having multiple bores formed therein.

23. The apparatus according to claim 22, wherein each of the fluid paths extends at least partially in a respective one of the bores.

24. The apparatus according to claim 13, wherein the fluid conductor includes first and second elongated members, one of the fluid paths extending between the first and second members.

25. The apparatus according to claim 13, wherein the fluid conductor includes first and second tubular members, a first one of the fluid paths extending within the first tubular member, and a second one of the fluid paths extending between the first and second tubular members.

26. The apparatus according to claim 25, wherein the first tubular member is positioned at least partially within the second tubular member.

27. A method of providing fluid communication for multiple fluid paths through an aperture formed through a well bulkhead, the method comprising the steps of:

positioning a fluid conductor at least partially within the aperture, the fluid paths extending within the fluid conductor; and forming at least one of the fluid paths as an annular space disposed between multiple tubular members of the fluid conductor.

28. The method according to claim 27, wherein in the positioning step, the aperture is formed through a pressure-bearing portion of the well bulkhead outside of a central flow passage formed axially through the well bulkhead.

29. The method according to claim 28, wherein in the positioning step, the pressure-bearing portion of the well bulkhead is a flange of a wellhead.

30. The method according to claim 28, wherein in the positioning step, the pressure-bearing portion of the well bulkhead is an outer portion of a packer.

31. A method of providing fluid communication for multiple fluid paths through an aperture formed through a well bulkhead, the method comprising the steps of:

positioning a fluid conductor at least partially within the aperture, the fluid paths extending within the fluid conductor; and providing the fluid conductor including a first tubular member disposed within a second tubular member, a first one of the fluid paths being formed within the first tubular member, and a second one of the fluid paths being formed between the first and second tubular members.

32. The method according to claim 31, wherein in the positioning step, the aperture is formed through a pressure-bearing portion of the well bulkhead outside of a central flow passage formed axially through the well bulkhead.

33. The method according to claim 32, wherein in the positioning step, the pressure-bearing portion of the well bulkhead is a flange of a wellhead.

34. The method according to claim 32, wherein in the positioning step, the pressure-bearing portion of the well bulkhead is an outer portion of a packer.

35. An apparatus for use in providing multiple fluid paths in a well, the apparatus comprising:

a well bulkhead having an aperture formed therethrough; and a fluid conductor positioned at least partially in the aperture, the fluid conductor including multiple tubular members, a first one of the fluid paths being disposed within a first one of the tubular members, and a second one of the fluid paths being disposed between the first tubular member and a second one of the tubular members.

36. The apparatus according to claim 35, wherein the first tubular member is positioned within the second tubular member and the second fluid path is an annular space between the first and second tubular members.

37. The apparatus according to claim 35, wherein the aperture is formed through a pressure-bearing portion of the well bulkhead outside of a central flow passage formed axially through the well bulkhead.

38. The apparatus according to claim 37, wherein the pressure-bearing portion of the well bulkhead is a flange of a wellhead.

39. The apparatus according to claim 37, wherein the pressure-bearing portion of the well bulkhead is an outer portion of a packer.

* * * * *